US009217617B1

(12) United States Patent
Mapes

(10) Patent No.: US 9,217,617 B1
(45) Date of Patent: Dec. 22, 2015

(54) AMMUNITION MAGAZINE INSERTION GUIDE FOR A BULLPUP PATTERN RIFLE

(71) Applicant: James Grant Mapes, Northglenn, CO (US)

(72) Inventor: James Grant Mapes, Northglenn, CO (US)

( * ) Notice: Subject to any disclaimer, the term of this patent is extended or adjusted under 35 U.S.C. 154(b) by 0 days.

(21) Appl. No.: 14/544,633

(22) Filed: Jan. 28, 2015

(51) Int. Cl.
*F41A 17/38* (2006.01)
*F41A 9/00* (2006.01)

(52) U.S. Cl.
CPC ..... *F41A 17/38* (2013.01)

(58) Field of Classification Search
CPC ..... F41A 17/38; F41A 9/00; F41A 9/01; F41A 9/24; F41A 9/25; F41A 9/38; F41A 9/54; F41A 9/55; F41A 9/56; F41A 9/59; F41A 9/60
USPC ..... 42/1.02, 90, 85, 106, 49.02, 49.01; 89/33.01, 33.1, 33.5; D22/108
See application file for complete search history.

(56) References Cited

U.S. PATENT DOCUMENTS

| | | | | |
|---|---|---|---|---|
| 3,999,321 | A | 12/1976 | Musgrave | |
| 4,520,585 | A | 6/1985 | Barrett | |
| 4,570,370 | A | 2/1986 | Smith | |
| 5,052,140 | A | 10/1991 | Smith | |
| 5,253,442 | A | 10/1993 | Kim | |
| 5,621,995 | A | 4/1997 | Smith | |
| D487,791 | S | 3/2004 | Freed | |
| D529,983 | S | 10/2006 | Yu | |
| D600,771 | S * | 9/2009 | Fitzpatrick | D22/108 |
| 7,743,542 | B1 | 6/2010 | Novak | |
| 7,805,874 | B2 | 10/2010 | Tal | |
| 7,823,312 | B2 * | 11/2010 | Faifer | F41A 9/61 42/49.02 |
| D644,291 | S * | 8/2011 | Faifer | D22/108 |
| 8,127,480 | B1 * | 3/2012 | McManus | F41A 9/61 42/49.02 |
| 8,418,390 | B1 * | 4/2013 | Wright | F41A 9/61 42/49.01 |
| D693,421 | S * | 11/2013 | Acarreta | D22/108 |
| 8,572,875 | B2 * | 11/2013 | Sisgold | F41A 9/66 42/1.02 |
| 8,683,725 | B2 | 4/2014 | Munson | |
| 8,726,554 | B2 | 5/2014 | Klassen | |
| D725,218 | S * | 3/2015 | Iosilevsky | D22/108 |
| D726,863 | S * | 4/2015 | Crume, Sr. | D22/108 |
| D727,454 | S * | 4/2015 | Robinson | D22/108 |
| 2006/0048430 | A1 * | 3/2006 | Crandall | F41A 9/47 42/71.01 |
| 2013/0104440 | A1 * | 5/2013 | Addis | F41A 17/38 42/90 |
| 2013/0180143 | A1 * | 7/2013 | Delgado Acarreta | F41A 9/71 42/1.02 |
| 2013/0269231 | A1 * | 10/2013 | Pietrzyk | F41A 17/38 42/6 |
| 2014/0150639 | A1 * | 6/2014 | Sugg | F41A 3/68 89/193 |
| 2014/0230297 | A1 * | 8/2014 | Larson, Jr. | F41A 17/38 42/6 |

FOREIGN PATENT DOCUMENTS

WO WO 2013/173871 11/2013

OTHER PUBLICATIONS

Gun Parts corporation.
High Plains Gun shop select magazine receiver.
Magazine Funnel Narrow CZUB.CZ.
Never Quit.
Arredondo AR-15 magazine well.
Grip Well Review for AR-15.

* cited by examiner

*Primary Examiner* — Bret Hayes
*Assistant Examiner* — Derrick Morgan
(74) *Attorney, Agent, or Firm* — Henry L. Smith, Jr.

(57) ABSTRACT

An exemplary embodiment includes a molded ammunition magazine insertion guide for a bullpup pattern rifle.

10 Claims, 20 Drawing Sheets

AMMUNITION MAGAZINE INSERTION GUIDE FOR A BULLPUP PATTERN RIFLE

STATEMENT REGARDING FEDERALLY SPONSORED RESEARCH AND DEVELOPMENT

None

BACKGROUND AND TECHNICAL FIELD

One useful embodiment or variation of the invention relates to the following field, although the invention may also relate to other fields and uses. The invention may have various embodiments and variations. The general field is an ammunition magazine guide for a rifle.

BACKGROUND

Description of Related Art

Typical of the art related to widely useful embodiments and variations of the present invention are following patents [and publications]. The following examples of related art and its limitations are illustrative and not exclusive. Other limitations of the related art will become apparent to those skilled in the art upon study of the specification and drawings of this application. Other embodiments and variations of the invention may relate to other arts and uses.

US Pub. 2013/0269231 is for a device to allow magazine for different firearms of same caliber to interchangeably use the other firearm's magazine, which normally will not fit. While it serves as a guide for a conventional rifle (M14, M1A, AR10), it is not a funnel guide, in other words it allows interchangeability but it does not make insertion easier. U.S. Pat. Nos. 7,823,312; 8,127,480; US Pub. 2013/0104440. These patents are for similar devices to the subject invention. They have a similar purpose for conventional rifles with a forward magazine, the first two for the AR15 and the last one for the AK47. They variously involve attachment to the trigger guard as an anchor point (which is quite different from th present invention) or around the magazine housing part of the receiver. While this latter part of the attachment means is similar, multiple patents incorporate the same means and is not what is claimed as being unique in the present invention. That is, other than fitting certain rifles, the aforementioned patents are for devices that fit those guns, and they will not fit each other or any other firearm than the specific one they are designed for. To fit them on any bullpup rifle would require making a totally new part; their dimensions and amount of material would not facilitate even extensive modification to work in that case. That said, the present invention aims to achieve the same goal as these devices in these patents, where a different approach, manner of function and method of insertion are needed.

Principally the main difference of one important embodiment of the present invention is the method of insertion coupled with/facilitated by the shape for bullpup—magazine behind trigger—rifles. The magwell (magazine well) unlike all others known to the inventor is designed to first engage the magazine's top rear surface in a near horizontal backward (toward operator) motion indexed from the operator's trigger hand. Once the rear of magazine engages it will be mostly aligned side to side and can be forcefully shoved upward into the gun. All other magwells are designed to have the magazine inserted from the bottom up, this being due to the position of the magwell in front of the trigger where the operator's vision can assist in alignment. The present invention is for guns where the magazine is not in the operators view, so that tactile and ergonomic factors assist in insertion where vision is absent.

SUMMARY

One of the widely useful embodiments and variations of the present invention may be summarized as follows. This embodiment or variation is exemplary only. Other embodiments and variations will become apparent to those skilled in the art upon study of the specification and drawings of this application. Other embodiments and variations of the invention may relate to other arts and have usefulness in those arts. As used herein, all references to the "invention" or "device" include other possible variations and embodiments referred to herein. An exemplary embodiment includes a molded ammunition magazine insertion guide for a bullpup pattern rifle A bullpup rifle is one that has the magazine and firing chamber behind the trigger, normally in the stock at the rear of the rifle. This shortens the overall length by roughly ⅓ allowing better maneuverability in tight spaces. It requires some additional parts to achieve function, i.e. a linkage bar between trigger and hammer which is far behind the trigger, whereas in a conventional rifle it would be right above the trigger. Conventional rifles have their chamber in front of the trigger and the stock is extra length. The location of the bullpup's chamber puts the magazine opening under the operator's firing arm, not a normal position, and incurs some difficulty in magazine changes that this invention is designed to address.

Problem: A bullpup pattern rifle requires a user to insert a magazine by feel alone unless the user takes his eyes and/or the rifle off target during magazine swap.

Magazine changes on most bullpups are slower (sometimes much slower) because they require more rifle repositioning, and can be difficult to see without fully dismounting the rifle.

A conventional rifle allows one to see one's magazine changes, and is more easily maneuvered with one's dominant hand, which makes mag changes easier in general. Human beings can naturally bring their hands together in the dark. As a basic design guideline, magazine wells should either be in one's dominant hand, or just in front of it; because it is far more difficult to manipulate anything well that is located behind one's dominant hand.

Solution: Provide a magazine guide that allows operator to accomplish reload by feel and reliably by using a consistent method of insertion.

Purposes and Advantages

The invention may have various embodiments and variations and may be useful in different fields and for different purposes. The purposes and advantages of the more widely useful embodiments or variations of the present invention include, but are not limited to, the following, and may include other purposes and advantages in different fields of use not listed herein:

1. To easily insert an ammunition magazine into a bullpup pattern type rifle without excessive fumbling or taking the eye off the target. Example fitted for the IWI Tavor rifle. Bullpup rifles have an inherent disadvantage versus conventionally configured rifles (magazine forward of trigger or in a pistol grip). The operators can see the magazine in other firearms and use their eyes to assist in aligning and inserting said magazine. In a bullpup rifle, the magazine in inserted into the underside of the stock, under the operator's arm and out of their field of view. This means increased fumbling, time to load or having to take the eyes off the target (dangerous in combat situations).

2. Prior art in terms of magazine well extensions, funnels and guides involve vertically inserting the magazine from the underside of the firearm in a strait vertical motion, assisted in alignment by eyesight. The present invention uses horizontal motion to engage the magazine in a fluted channel from an index position (described below) then achieves reliable vertical insertion via the concave surface of the rest of the lower interior of the invention, which forces the magazine into alignment as it rises into the magazine well in the receiver of the rifle.

Ergonomics have shown that a neurologically unimpaired person can instinctively bring their hands together in the dark (situation 1). Putting the off hand in front of the strong hand also can be achieved with relative precision (situation 2). However, it has been found that accurate indexing of the weak hand behind the strong hand is difficult to impossible for most people (situation 3). The magazine is almost always loaded with the weak off hand, which in the case of a bullpup pattern rifle is situation 3. By using situation (1) the invention provides the operator with a reliable starting point to begin an insertion method which appears to be unique (no prior art) in terms of loading a firearm. (A) From the index point (1) the operator moves the magazine backward and upward from the strong hand under the gun, (B) whereupon the lower part of the invention will engage the upper back surface of the magazine, funneling it into a channel shaped like the back of the magazine well above. At this point the magazine can go no further backward, (C) the operator then shoves the magazine upward where the sides of the invention force alignment of the magazine to match the internal magazine well of the gun. This motion done fluidly results in an angled approach by the top of the magazine until engagement and then seating the magazine with the upward force. Indexing here refers to positioning, specifically from a defined starting point. There are 3 situations where a person brings their hands together on a line (the line being the firearm back to front). Situation 1 was weak hand brought to strong hand (hands together), 2 was weak hand in front of strong hand (conventional rifle magazine location and also ergonomically easy), 3 weak hand behind strong hand (ergonomically bad, lacks instinctive precision).

The firearm here requires situation 3 (weak behind strong) when not modified, which is the worst case scenario with regards to precision. Thus the invention is designed to allow a person to bring the hands together as a starting (index) point, using an instinctive ergonomic advantage in situation 1, then moving the magazine back and up into the magazine well extension that provides tactile feedback and guidance in the process.

3. With the invention and utilizing the corresponding method, the operator can achieve an A-B-C reliable magazine insertion every time. Attempting to do so by simply vertically engaging the magazine into the well (even with its fluting) results in repeated failures to engage, fumbling and lost time till next round availability.

4. An inexperienced person would have a long reload time that can be cut in half or better by using this invention and a minute's time to learn the 3 step load process.

5. An experienced operator would normally have the muscle memory to hit the magazine well unassisted most every time, however under combat stress or when wounded, their coordination will decrease at which point the more forgiving and reliable method using the invention would confer an advantage.

6. In low light or no light conditions the invention presents over twice the surface area to hit and achieve insertion of a magazine versus an unequipped rifle.

7. Assembly of the invention onto the firearm is simple, the device constituting two halves that are molded to fit the bottom of the gun receiver around the magazine well area of the stock, with two indexing tabs and 3 screws to secure the invention in place. The shape of the gun receiver's trim also helps secure the invention from slippage due to its close fitted molding around said trim. See material on the L-shaped groove in the description of FIG. 11

8. The invention has a shallow indexing groove to align the index finger with the magazine release lever located in front and above the invention. See description of FIG. 12.

9. The back of the invention is configured to allow easy access to the bolt catch release lever of the gun located above and behind the magazine well in front of the back part of the stock.

10. The outer surfaces of the invention are thick and rounded to avoid sharp corners that would dig into or injure the operator in vigorous maneuvers and fit comfortably inside the arms when hunkered down with the weapon. (Unlike conventional rifles with a forward mounted magazine well, both arms have to reach past the bullpup rifle's magazine well, not just one. Conventional firearms also allow the magazine well to even be used as a makeshift grip due to the forward mounted magazine placement that is not practical with a bullpup rifle; therefore the magazine well guide has to be as unobtrusive as possible to the normal handling and operation of the firearm.)

11. This invention may help boost sales of the IWI Tavor rifle for which this embodiment is fitted. Since it would improve the combat effectiveness of less skilled operators, wounded skilled operators and any operator working in absence of light, it would serve to put the Tavor rifle with a clear advantage over any other bullpup patterned rifle available today. To whit, France is ditching their FAMAS bullpup rifles and seeking a more universal STANAG model (NATO standardized agreement between member nations on common equipment, i.e. magazines). The invention would significantly improve the IWI Tavor's marketability as that replacement.

REFERENCE NUMERALS IN DRAWINGS

1. insertion guide
2. bullpup rifle
3. ammunition magazine
4. right half of insertion guide
5. left half of insertion guide
6. magazine release lever channel
7. left lobe
8. right lobe
9. bolt hold open channel
10. screws

11. threaded insert
12. screw holes
13. receiver molding channel
14. cutout
15. magazine opening
16. interior front ramp surface channel
17. exterior of mating surfaces
18. outer surface of lower lobe
19. index finger indentation
20. round indentation
21. magazine release lever
22. interior surface
23. exterior surface
24. large end
25. small end
26. top
27. bottom
28. bottom edge
29. surface of larger end
30. extrusion

BRIEF DESCRIPTION OF THE DRAWINGS

This Brief Description and the Detailed Description Of The Drawings cover only some embodiments and variations of the invention, and other embodiments and variations will be clear to those skilled in the art from the description, drawings, and Alternative and Additional Embodiments, etc. The Drawings are illustrative and not limiting.

Some of the drawings contain lines which are from a CAD program to emphasize shapes, contours and surfaces which are not specifically labeled or given a part number. These features may be variable and are not necessarily required parts of the invention.

DETAILED DESCRIPTION OF THE DRAWINGS

Figure 1:
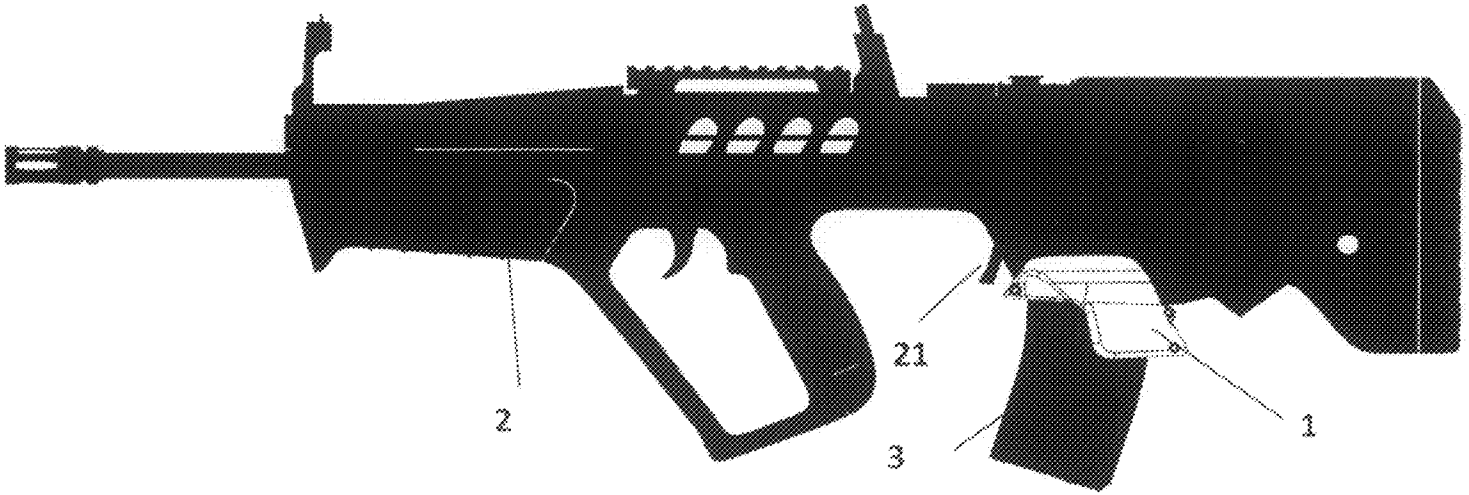
FIGS. 1-7 show the insertion guide 1 attached to the gun 2. The Figures are respectively in order: gun left side view, gun right side view, gun rear view looking at the back end of the gun and looking forward, gun rear iso right side view, gun rear iso left side view, gun front view looking at the front of the gun, and gun bottom view.

FIG. 1 is a left side view of the IWI Tavor rifle 2, insertion guide 1 magazine release lever 21 (part of rifle 2) and ammunition magazine 3 (AR15 type STANAG 5.56×45 mm magazine). The insertion guide 1 is mounted on the rifle 2, with the magazine 3 inserted thru the insertion guide 1 into the rifle 2. Magazine release lever 21 (part of rifle 2) is positioned in front and slightly above insertion guide 1 on rifle 2, this influences the necessity of magazine release lever channel 6 shown in later drawings.

Figure 2:
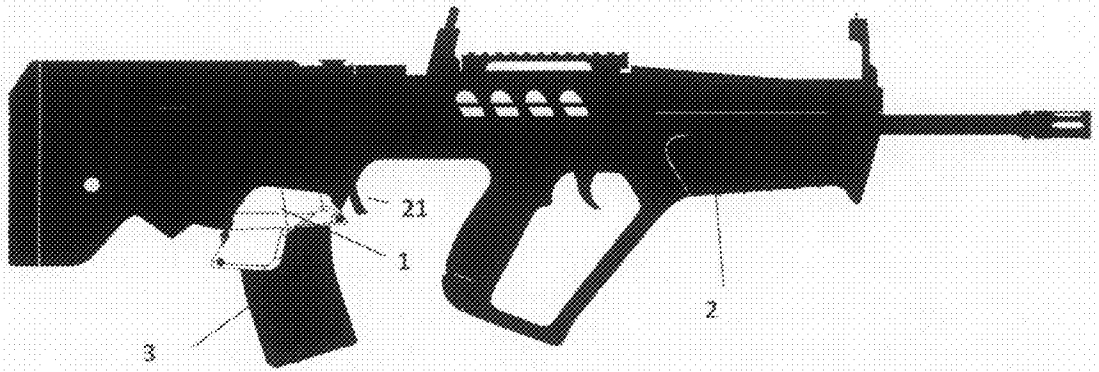

FIG. 2 is a right side view of the IWI Tavor rifle 2, insertion guide 1, magazine release lever 21 (part of rifle 2) and ammunition magazine 3. The insertion guide 1 is mounted on the rifle 2, with the magazine 3 inserted thru the insertion guide 1 into the rifle 2. Magazine release lever 21 is positioned in front and slightly above insertion guide 1 on rifle 2, this influences the necessity of magazine release lever channel 6 shown in later drawings.

Figure 3:
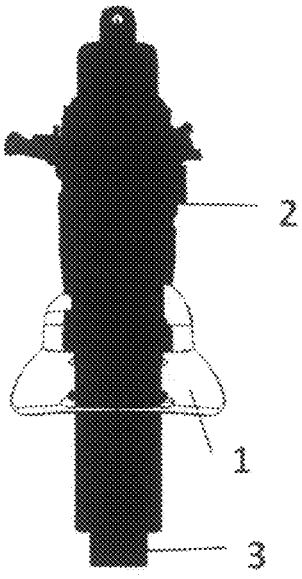

FIG. 3 is a rear view of the IWI Tavor rifle 2, insertion guide 1, and ammunition magazine 3. The insertion guide 1 is mounted on the rifle 2, with the magazine 3 inserted thru the insertion guide 1 into the rifle 2. Note the back of the stock partly obscures the insertion guide 1 mounted on the gun in this view.

Figure 4:
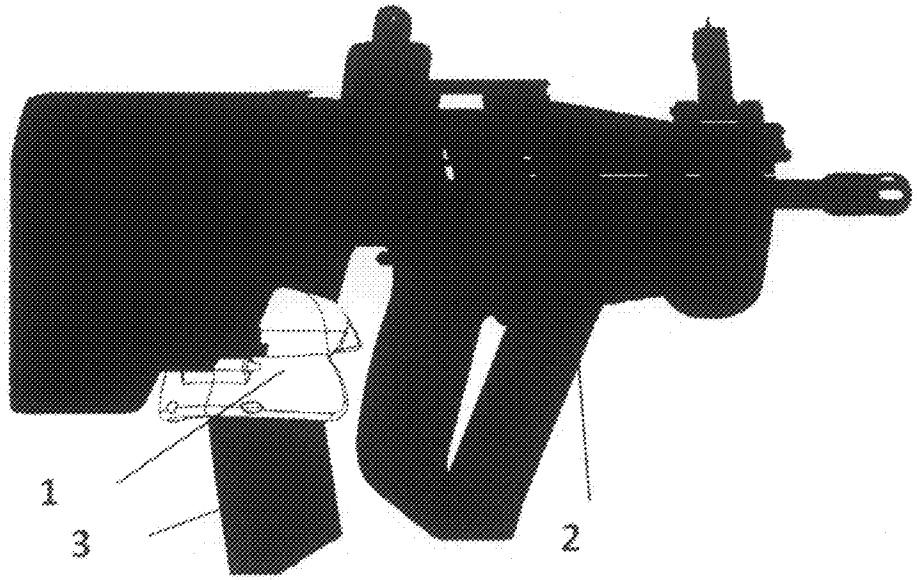

FIG. 4 is a rear right side view of the IWI Tavor rifle 2, insertion guide 1, and ammunition magazine 3. The insertion guide 1 is mounted on the rifle 2, with the magazine 3 inserted thru the insertion guide 1 into the rifle 2.

Figure 5:
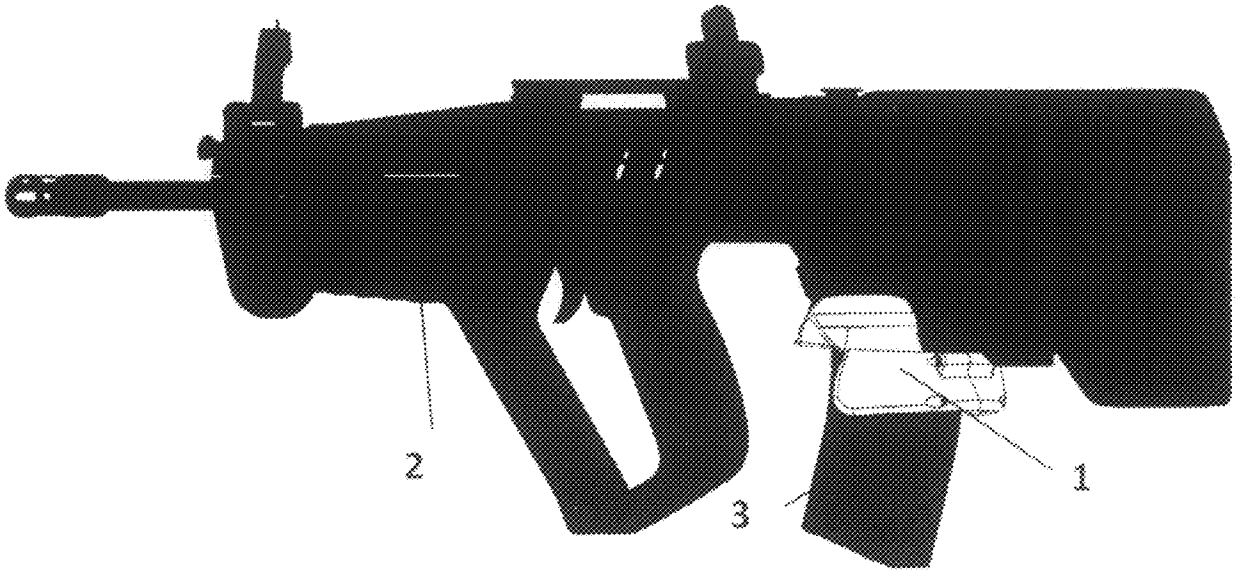

FIG. 5 is a rear left side view of the IWI Tavor rifle 2, insertion guide 1, and ammunition magazine 3. The insertion guide 1 is mounted on the rifle 2, with the magazine 3 inserted thru the insertion guide 1 into the rifle 2.

Figure 6:
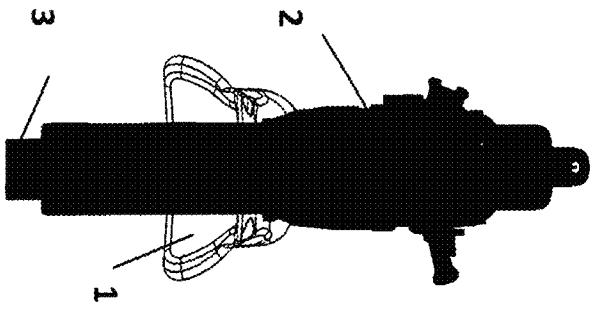

FIG. 6 is a front view of the IWI Tavor rifle 2, insertion guide 1, and ammunition magazine 3. The insertion guide 1 is mounted on the rifle 2, with the magazine 3 inserted thru the insertion guide 1 into the rifle 2. Note the trigger guard partly obscures the insertion guide 1 in this view.

Figure 7:
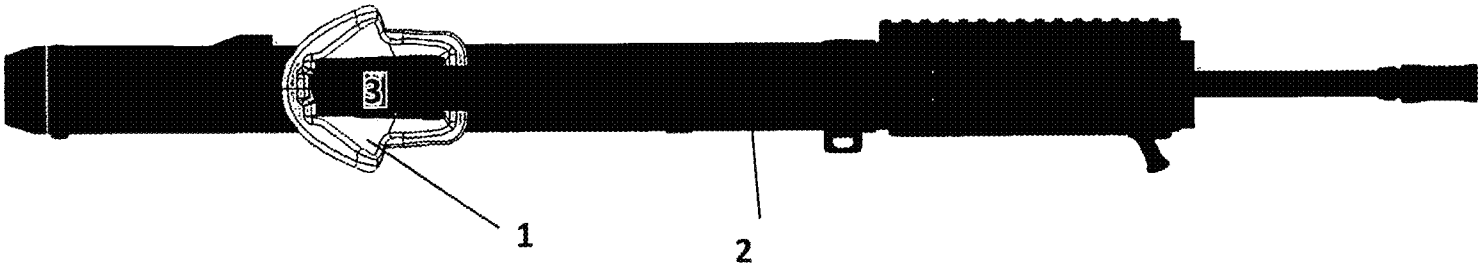

FIG. 7 is a bottom view of the IWI Tavor rifle 2, insertion guide 1, and ammunition magazine 3. The insertion guide 1 is mounted on the rifle 2, with the magazine 3 inserted thru the insertion guide 1 into the rifle 2.

Figure 8:
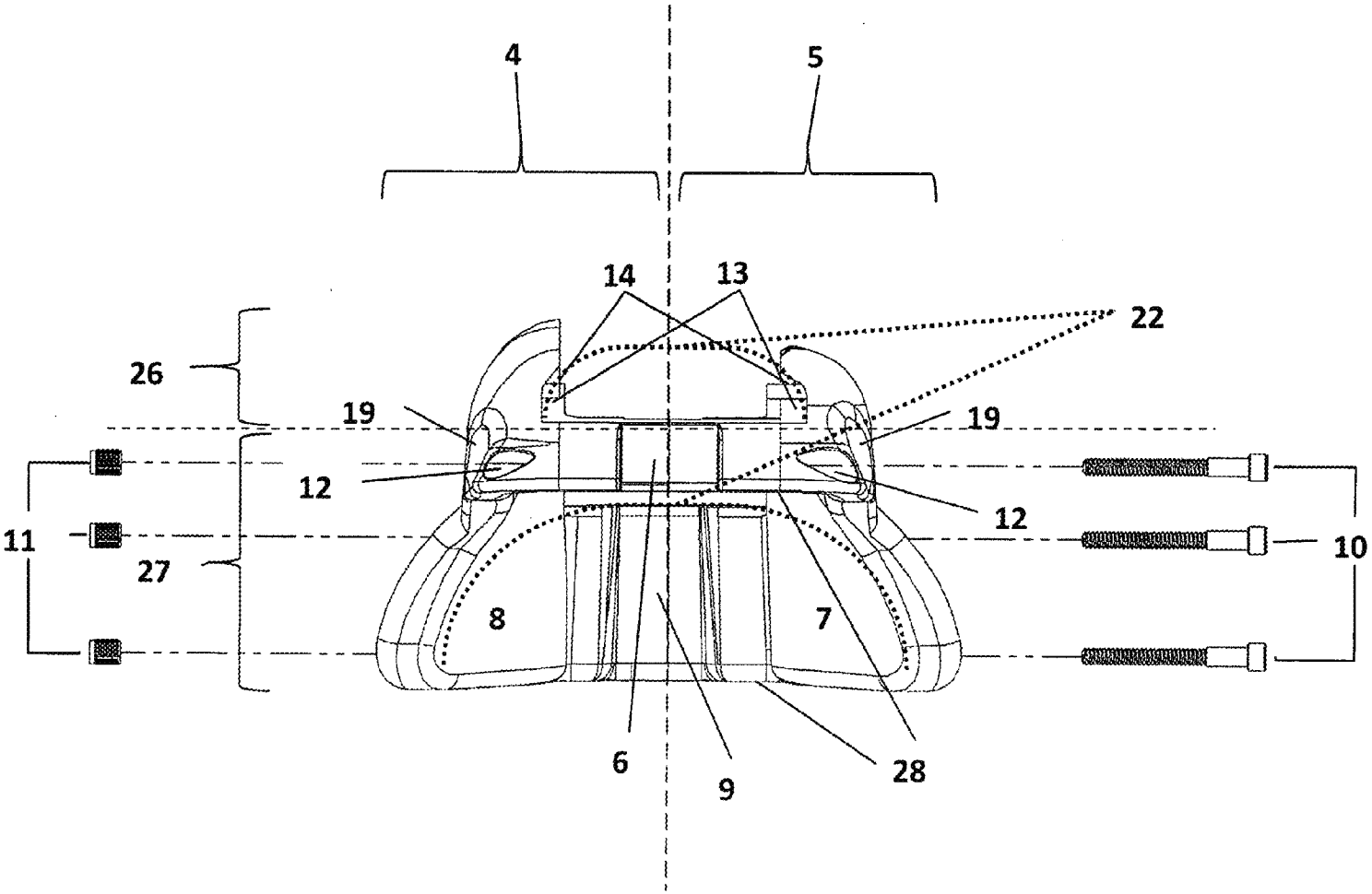
FIGS. 8-15 show details of the insertion guide.

FIG. 8 is a front view of the insertion guide 1 showing; right half 4, left half 5, magazine release lever channel 6, left lobe 7, right lobe 8, bolt hold open channel 9, screws 10 [McMaster-Carr product 92185A115 Type 316 Stainless Steel Socket Head Cap Screw, 4-40 Thread, 1" Length], threaded inserts 11 [McMaster-Carr product 92394A112 18-8SS Press-Fit Expansion Insert for Plastic without Flange, 4-40 Internal Thread, 3/16" Length], screw holes (front) 12, receiver molding channel 13 (channel form fitted to molding on lower receiver of rifle), cutout 14 (end of #13 groove where the molding leaves the device), index finger indentation 19, interior surface 22, top 26, bottom 27 and bottom edge 28. Parts right half 4 and left half 5 are the two complete halves of the entire insertion guide 1, they have mating surfaces to fit flush together and against the receiver of the rifle 2. The two halves are not perfectly symmetrical as the rifle 2 is not perfectly symmetrical laterally, there are pins and housing that had to be accommodated with the shape of right half 4 and left half 5 that make their height and thickness from center differ. Primary attachment is from the receiver molding channel 13 which is a matched casting of the molding along the lower receiver of the rifle; it is a complex shape which is a roughly 45 degree slope on one side and a curve on the other of the full depth. By form fitting against the molding it provides the main gripping and restricts any motion or slippage of insertion guide 1 on rifle 2 once installed. Cutout 14 is where the molding of the rifle 2 receiver continues along the bottom of rifle 2 outside the area covered by insertion guide 1, and is in fact a cross sectional view of receiver molding channel 13 where that juncture occurs in front and back. Left lobe 7 and right lobe 8 along with bolt hold open channel 9 form the lower interior surface to which a magazine 3 is inserted and first makes contact, guided by these parts to align underneath the magazine well of rifle 2. Bolt hold open channel 9 is fitted to the contour of the back of an AR15 STANAG type magazine. The magazine release lever channel 6 allows the magazine release lever 21 (not shown, part of rifle 2) to fully be depressed when ejecting a magazine 3, it is cut into the front face of the insertion guide 1, shallower at top and deeper at the bottom due to the slope of the front face of the insertion guide 1. Screw holes 12 on left and right sides are for the screws 10 (left side in drawing) and inserts 11 (right side in drawing) as a means to hold right half 4 and left half 5 together, the screw holes 12 allow the screws 10 to not protrude from insertion guide 1 to snag on clothing, objects or skin. Index finger indentation 19 is a shallow groove that allows the index finger of the operator to lay along and around the edge of insertion guide 1 to access the magazine release lever 21 (not shown on this drawing) part of the rifle 2. It is an ergonomic feature only, provided to allow the normal operation of the rifle 2 with insertion guide 1 in place. Interior surface 22 is the entire inner surface of right half 4 and left half 5 which bounds magazine opening 15 (not shown in this view) or mates to the rifle 2 (not shown); this comprises inner surface of left lobe 7 and right lobe 8, bolt hold open channel 9, receiver molding channel 13, interior front ramp surface channel 16 (not shown in this view). Top 26 is the upper sections of right half 4 and left half 5 and contains the parts that mate with the rifle 2 to provide fit; receiver molding channel 13 defines the lower boundary of the top of insertion guide 1 as well as exterior of mating surfaces 17. Bottom 27 is the lower sections of right half 4 and left half 5 that compose the funnel portion (interior of left lobe 7 and right lobe 8, bolt hold open channel 9, interior front ramp surface channel 16) that guides the magazine 3 (not shown) into the rifle 2 (not shown). Bottom edge 28 is the extreme lower boundaries of magazine release lever channel 6, left lobe 7, right lobe 8, bolt hold open channel 9, interior front ramp surface channel 16, exterior of mating surfaces 17 (not shown in this drawing), interior surface 22 and exterior surface 23 (not shown in this drawing).

Figure 9:
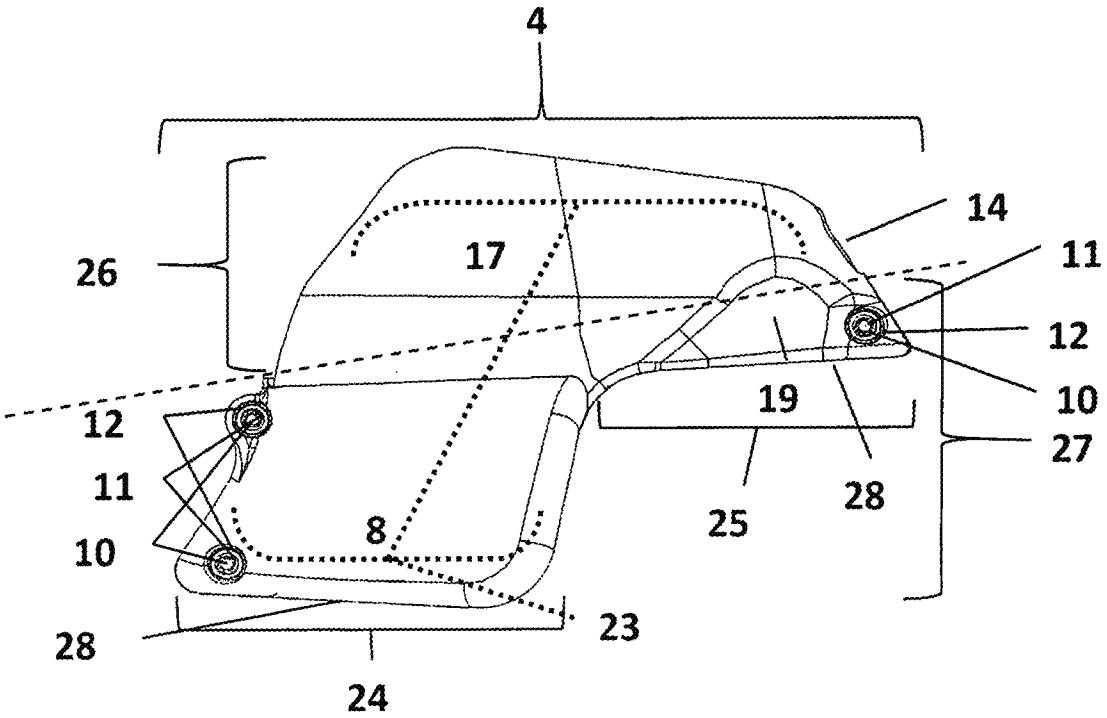

FIG. 9 is a right side view of the insertion guide 1 showing; right half 4, right lobe 8, screws 10 [McMaster-Carr product 92185A115 Type 316 Stainless Steel Socket Head Cap Screw, 4-40 Thread, 1" Length], inserts 11 [McMaster-Carr product 92394A112 18-8SS Press-Fit Expansion Insert for Plastic without Flange, 4-40 Internal Thread, 3/16" Length], screw holes 12, exterior of mating surface 17, index finger indentation 19, exterior surface 23, larger end 24, small end 25, top 26, bottom 27 and bottom edge 28. In this view only the end of the screw 10 showing through the insert would be visible as the screws 10 are placed on the left side with the inserts 11 being on the near side. The screw holes 12 are recessed to prevent the screws from protruding and snagging clothing etc. Right half 4 consists of lower lobe 8 and exterior of mating surfaces 17 and exterior surface 23; the outer surfaces may be textured to match the rifle 2. Index finger indentation 19 is a shallow groove that allows the index finger of the operator to lie along and around the edge of insertion guide 1 to access the magazine release lever 21 (not shown on this drawing) part of the rifle 2. The large end 24 includes the left lobe 7 and right lobe 8, screw holes 12, bolt hold open channel 9 and all other features on the rear of insertion guide 1. The small end 25 includes features forward of and excluding left lobe 7 and right lobe 8—magazine release lever channel 6 (not shown), screw hole 12, interior front ramp surface channel 16 (not shown), index finger indentation 19. Both large end 24 and small end 25 share common features of top 26 such as receiver molding channel 13, cutout 14, exterior of mating surfaces 17. Top 26 is the upper sections of right half 4 and left half 5 (not shown) and contains the parts that mate with the rifle 2 to provide fit; receiver molding channel 13 defines the lower boundary of the top of insertion guide 1 as well as exterior of mating surfaces 17. Bottom 27 is the lower sections of right half 4 and left half 5 that compose the funnel portion (interior of left lobe 7 and right lobe 8, bolt hold open channel 9, interior front ramp surface channel 16) that guides the magazine 3 (not shown) into the rifle 2 (not shown). Bottom edge 28 is the extreme lower boundaries of magazine release lever channel 6 (not shown), left lobe 7 (not shown), right lobe 8, bolt hold open channel 9 (not shown), interior front ramp surface channel 16 (not shown), exterior of mating surfaces 17, interior surface 22 (not shown) and exterior surface 23.

Figure 10:
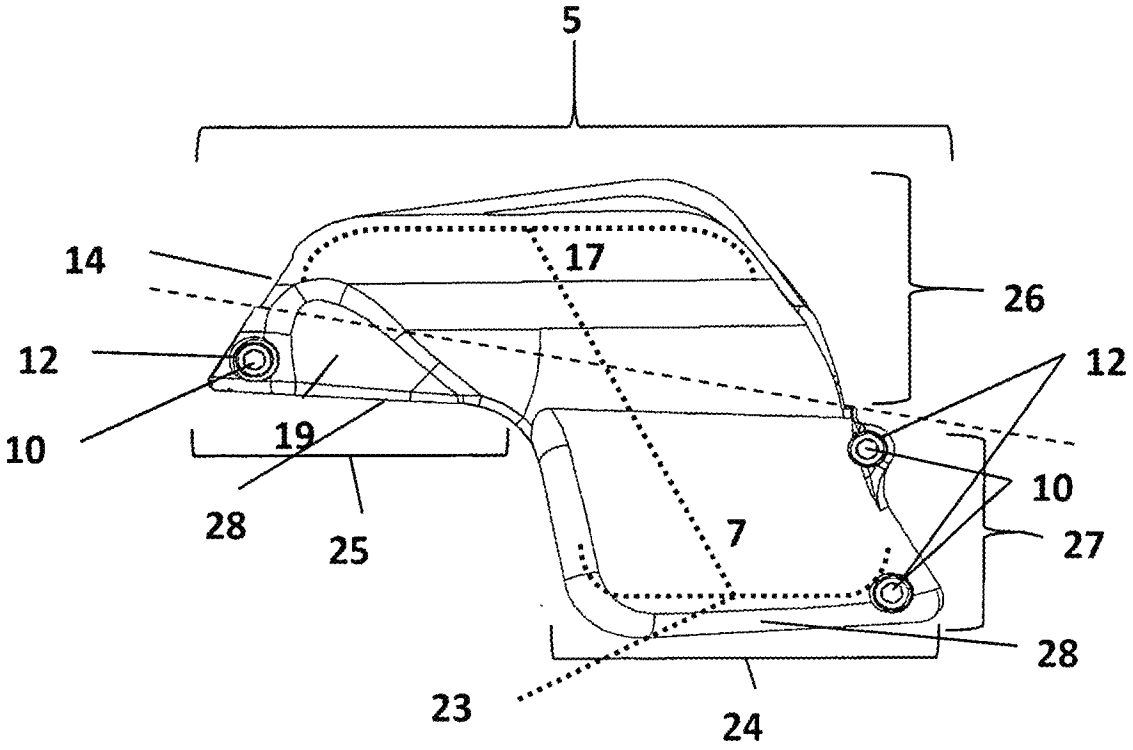

FIG. 10 is a left side view of the insertion guide 1 showing; left half 5, left lower lobe 7, screws 10[McMaster-Carr product 92185A115 Type 316 Stainless Steel Socket Head Cap Screw, 4-40 Thread, 1" Length], screw holes 12, exterior of mating surface 17, index finger indentation 19, exterior surface 23, larger end 24, small end 25, top 26, bottom 27 and bottom edge 28. In this view the inserts 11 would not actually be visible as the screws 10 are placed on the left (near) side in screw holes 12, recessed to prevent snagging on clothing etc. Left half 5 consists of left lower lobe 7, exterior surface 17 and exterior surface 23; the outer surfaces may be textured to match the rifle 2. Index finger indentation 19 is a shallow groove that allows the index finger of the operator to lie along and around the edge of insertion guide 1 to access the magazine release lever 21 (not shown on this drawing) part of the rifle 2. The large end 24 includes the left lobe 7 and right lobe 8, screw holes 12, bolt hold open channel 9 and all other features on the rear of insertion guide 1. The small end 25 includes features forward of and excluding left lobe 7 and right lobe 8—magazine release lever channel 6 (not shown), screw hole 12, interior front ramp surface channel 16 (not shown), index finger indentation 19. Both large end 24 and small end 25 share common features of top 26 such as receiver molding channel 13, cutout 14, exterior of mating surfaces 17. Top 26 is the upper sections of right half 4 (not shown) and left half 5 and contains the parts that mate with the rifle 2 to provide fit; receiver molding channel 13 defines the lower boundary of the top of insertion guide 1 as well as exterior of mating surfaces 17 and round indentation 20 (not visible in this view) to fit the magazine latch's pivot pin housing. Bottom 27 is the lower sections of right half 4 and left half 5 that compose the funnel portion (interior of left lobe 7 and right lobe 8, bolt hold open channel 9, interior front ramp surface channel 16) that guides the magazine 3 (not shown) into the rifle 2 (not shown). Bottom edge 28 is the extreme lower boundaries of magazine release lever channel 6 (not shown), left lobe 7, right lobe 8 (not shown), bolt hold open channel 9 (not shown), interior front ramp surface channel 16 (not shown), exterior of mating surfaces 17, interior surface 22 (not shown) and exterior surface 23.

Figure 11:
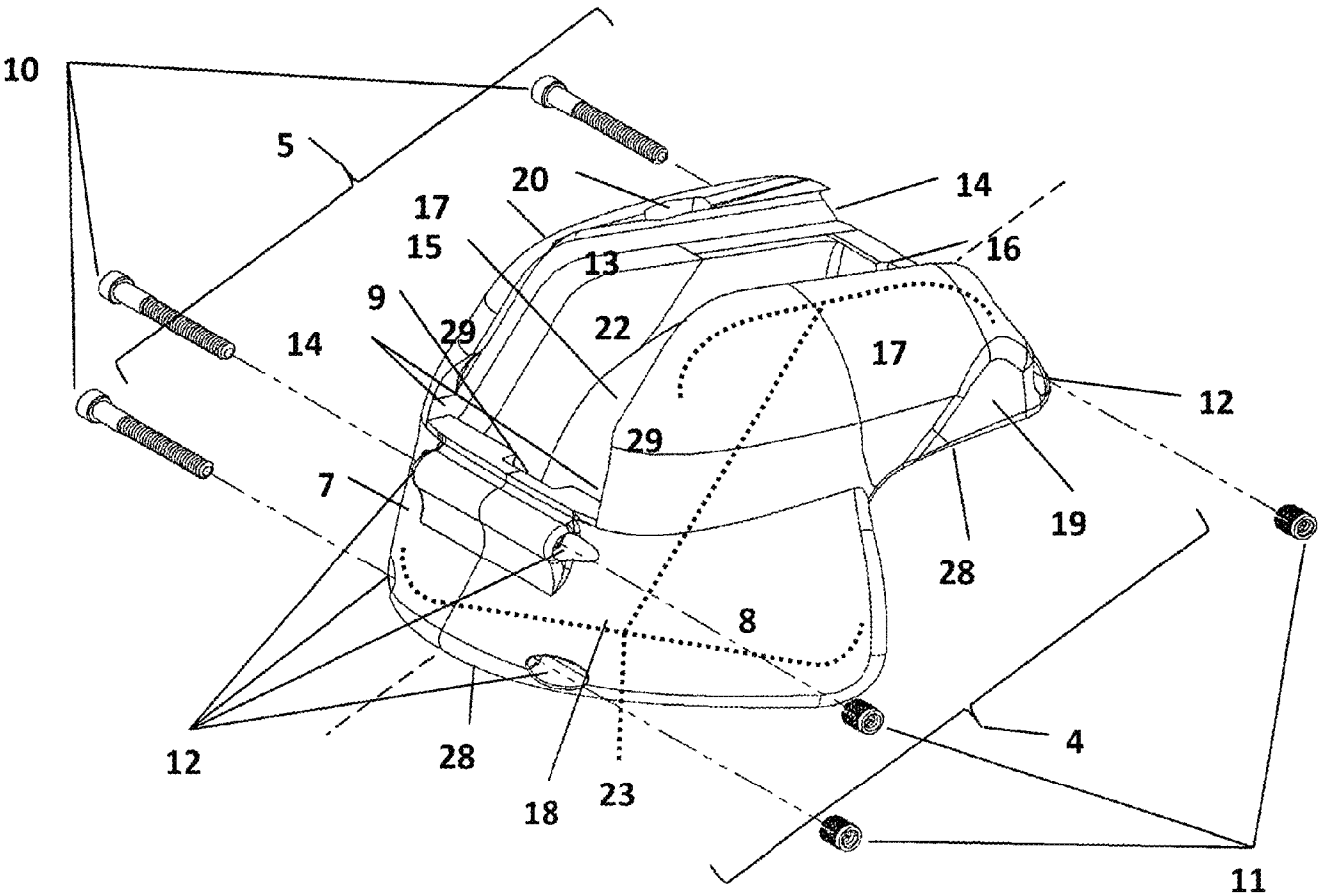

FIG. 11 is an isometric view from the high right rear viewing angle showing; right half 4, left half 5, left lower lobe 7, right lower lobe 8, bolt hold open channel 9, screws 10 [McMaster-Carr product 92185A115 Type 316 Stainless Steel Socket Head Cap Screw, 4-40 Thread, 1" Length], threaded inserts 11 [McMaster-Carr product 92394A112 18-8SS Press-Fit Expansion Insert for Plastic without Flange, 4-40 Internal Thread, 3/16" Length], screw holes 12, receiver molding channel 13, cutout 14, magazine opening 15, interior front ramp surface channel 16 (matches magazine well contour), exterior of mating surfaces 17, outer surface of right lobe 8, index finger indentation 19 (for index finger to access magazine release lever along front corners), a round indentation 20 (in upper surface to fit magazine latch's pivot pin housing), interior surface 22, exterior surface 23, bottom edge 28 and surface of larger end 29. Parts right half 4 and left half 5 comprise the structure of insertion guide 1, held together by screws 10 and inserts 11 connected thru screw holes 12 which are recessed to prevent snagging on clothing etc. Each half comprises a lower lobe, left lobe 7 (far side) and right lobe 8 (near side) shown and exterior of mating surfaces 17. The top edge of the bolt hold open channel 9 is visible between and just above the upper rear screw holes 12 as a square notch in the interior back top surface. The receiver molding channel 13 is visible on the left half 5 in its full length, this is molded to fit the trim on the lower receiver of rifle 2 and provide a snug fit and anchor insertion guide 1 in place on rifle 2. Cutout 14 is shown at the back and front end of receiver molding channel 13, this is where the molding trim exits the body of insertion guide 1, and since it exits at an angle the cutout is a cross section of the receiver molding channel 13 taken at an angle. Magazine opening 15 is the open space between right half 4 and left half 5 that allows the magazine 3 to pass thru the insertion guide 1 into rifle 2 in its magazine well. As with bolt hold open channel 9 in this view, the left upper edge of interior front ramp surface channel 16 is visible as a notch in the forward interior surface just above the top of right half 4, this channel is fitted to the contour of a standard AR15 STANAG magazine 3 and interior of rifle 2 magazine well. Interior surface 22 is visible on the inside of left half 5 in this view. Exterior of mating surfaces 17 and outer surface of lower lobe 18 together comprise exterior surface 23 and are the textured surfaces that would be most visible when mounted on the rifle 2. Index finger indentation 19 is visible on the right forward edge; this allows the operator's index finger to better access the magazine release lever 21 of the rifle 2. Visible on the left half 5 at the top just above receiver molding channel 13 is a small round indentation 20, this exists to fit around the magazine latch pivot pin housing of rifle 2. Bottom edge 28 is the extreme lower boundaries of magazine release lever channel 6 (not shown), left lobe 7, right lobe 8, bolt hold open channel 9, interior front ramp surface channel 16, exterior of mating surfaces 17, interior surface 22 and exterior surface 23. The surface of larger end 29 designates the area just behind and outside the back portion of receiver molding channel 13 above cutout 14 on both halves of insertion guide 1.

Figure 12:
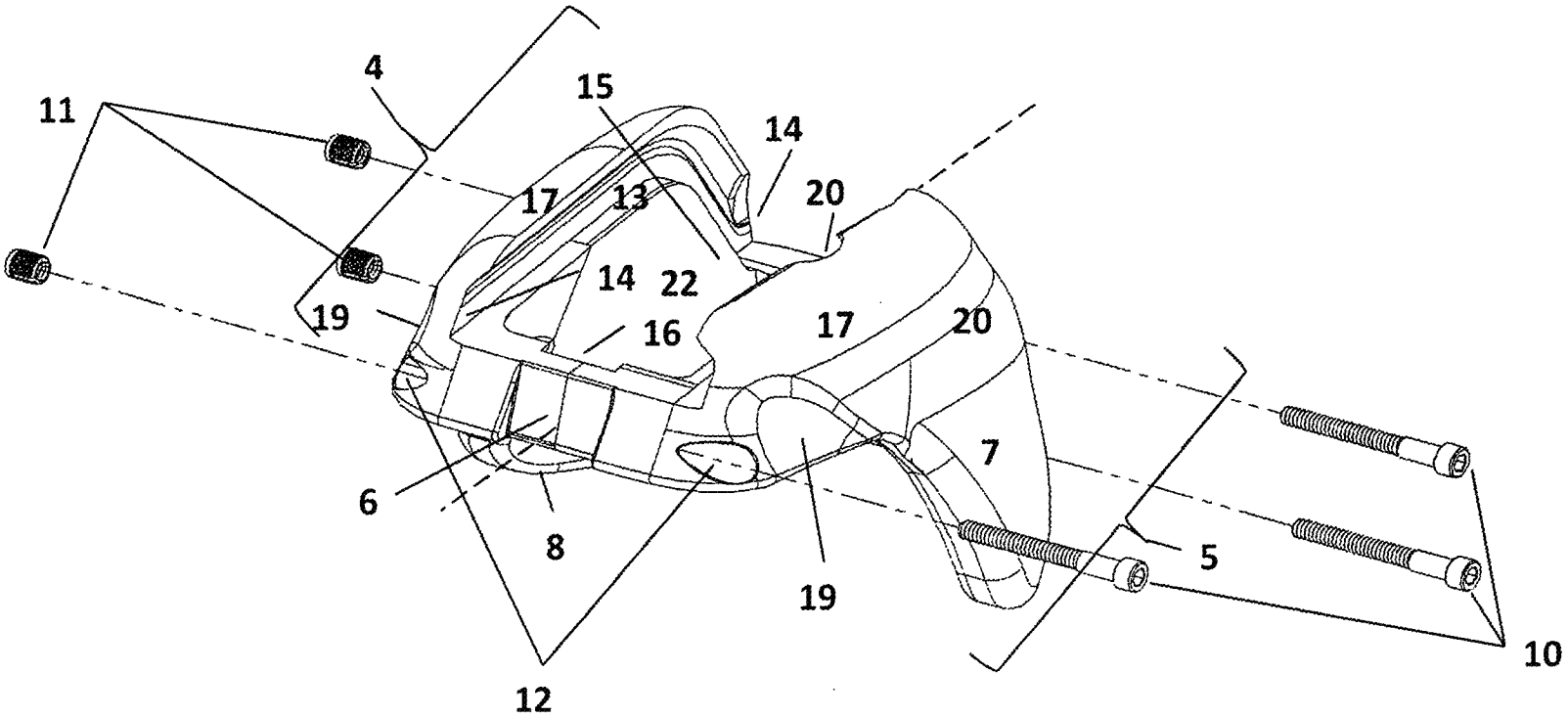

FIG. 12 is an isometric view opposite FIG. 11, viewing the insertion guide 1 from the high front left aspect showing; right half 4, left half 5, magazine release lever channel 6, left lobe 7, right lobe 8, screws 10 [McMaster-Carr product 92185A115 Type 316 Stainless Steel Socket Head Cap Screw, 4-40 Thread, 1" Length], threaded inserts 11 [McMaster-Carr product 92394A112 18-8SS Press-Fit Expansion Insert for Plastic without Flange, 4-40 Internal Thread, 3/16" Length], screw holes 12, receiver molding channel 13, cutout 14, magazine opening 15, interior front ramp surface channel 16, exterior of mating surfaces 17, index finger indentation 19, a round indentation 20 and interior surface 22. Right half 4 and left half 5 are comprised of right lobe 8 and left lobe 7 respectively along with exterior of mating surface 17 on both upper sections of each half and held together by screws 10 and inserts 11 connected thru screw holes 12 (1 set front, 2 sets back upper and lower). Magazine release lever channel 6 exists to allow the magazine release lever 21 (not shown, part of rifle 2) full range of travel when depressed to release a magazine 3 from rifle 2. Receiver molding channel 13 is visible on the right half 4 for its full length and is a matched casting of the molding along the lower receiver of the rifle, it is a complex shape which is a roughly 45 degree slope on one side and a curve on the other of the full depth. By form fitting against the molding it provides the main gripping and restricts any motion or slippage of insertion guide 1 on rifle 2 once installed. Cutout 14 is on the ends of receiver molding channel 13 to accommodate the trim molding that continues past the boundaries of insertion guide 1, the cutouts are of varying shape according to the angle at which the molding exits the device and are a cross section of receiver molding channel 13 at that point. Magazine opening 15 is the interior of insertion guide 1 bounded by its halves right 4 and left 5 allowing the magazine 3 to pass thru the insertion guide 1 into the rifle 2 in its magazine well. The top of interior front ramp surface channel 16 is visible as a notch in the interior front surface just behind magazine release lever channel 6. Index finger indentation 19 is just behind left front screw hole 12 and allows the operator's index finger to more comfortably access the magazine release lever 21 (not shown) of rifle 2. Round indentation 20 is visible on the interior side of the upper surface of left half 5, this is to allow the part to fit over the magazine latch pivot pin housing of the rifle 2. Part of Interior surface 22 is visible on the near side of right half 4.

Figure 13:
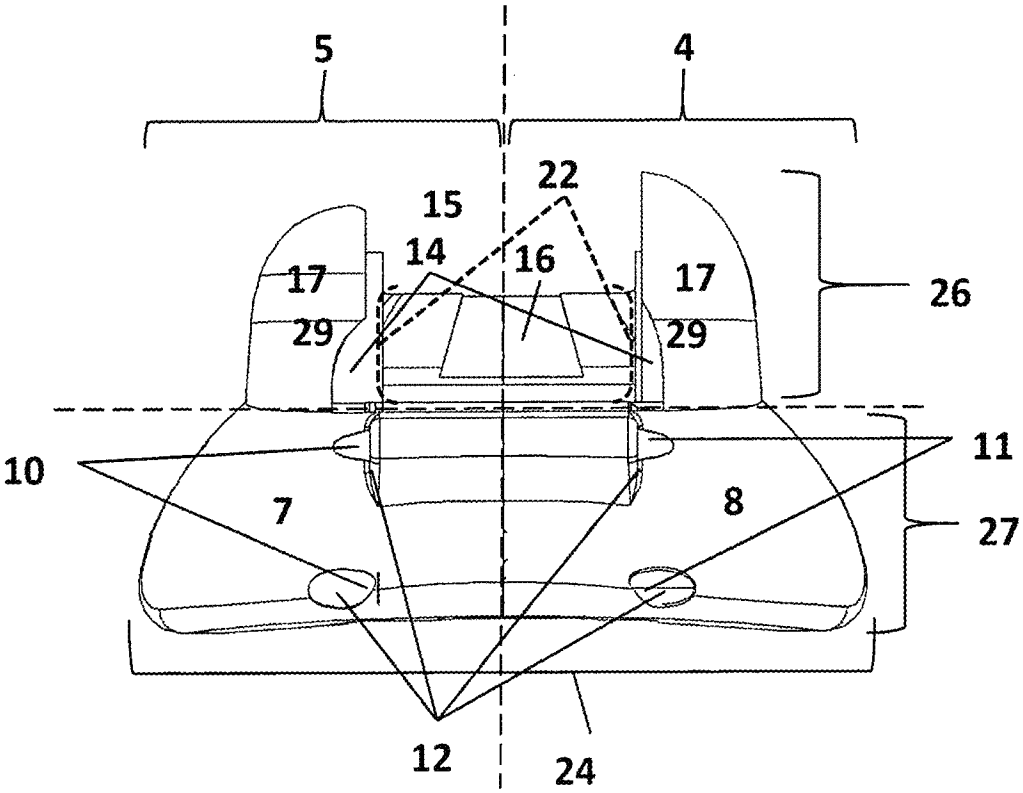

FIG. 13 is a back view of insertion guide 1 showing; right half 4, left half 5, left lobe 7, right lobe 8, screws 10 [McMaster-Carr product 92185A115 Type 316 Stainless Steel Socket Head Cap Screw, 4-40 Thread, 1" Length], threaded inserts 11 [McMaster-Carr product 92394A112 18-8SS Press-Fit Expansion Insert for Plastic without Flange, 4-40 Internal Thread, 3/16" Length], screw holes (rear upper and lower) 12, cutout 14, interior front ramp surface channel 16, interior surface 22, large end 24, top 26, bottom 27 and surface of large end 29. Right half 4 and left half 5 comprise the whole of insertion guide 1. The two halves are not perfectly symmetrical as the rifle 2 is not perfectly symmetrical laterally, there are pins and housing that had to be accommodated with the shape of right half 4 and left half 5 that make their height and thickness from center differ (in this view the height difference is accentuated). Left lobe 7 and right lobe 8 form a funnel for the magazine 3 (not shown) guiding it into alignment with the interior of the rifle's 2 magazine well. Screws 10, inserts 11 and screw holes 12 on the rear of insertion guide 1 are shown which hold right half 4 and left half 5 together. Cutout 14 is shown at the back end of receiver molding channel 13 (not shown), this is where the molding trim exits the body of insertion guide 1, and since it exits at an angle the cutout is a cross section of the receiver molding channel 13 taken at an angle. Interior front ramp surface channel 16 is shown looking from the back at the interior wall of the front of insertion guide 1, this channel has a taper from bottom to top that serves the same function as the lower lobes, to guide the magazine 3 (not shown) into alignment as this channel mates with a protrusion on the front of magazine 3. Front portion of interior surface 22 is visible thru the back of the insertion guide 1 & top 26. Top 26 comprises all features above receiver molding channel 13 inclusive (cutout 14 is visible, the back end of receiver molding channel 13). The entire view in FIG. 13 shows large end 24 except for the portion of interior surface 22 that is visible. Bottom 27 is the lower sections of right half 4 and left half 5 that compose the funnel portion (interior of left lobe 7 and right lobe 8, bolt hold open channel 9 (not shown), interior front ramp surface channel 16) that guides the magazine 3 (not shown) into the rifle 2 (not shown). Surface of larger end 29 is shown as the back end of exterior of mating surfaces 17, back of top 26; it is the area outside the receiver molding channel 13 (visible as cutout 14 which is the back end of that channel).

Figure 14:
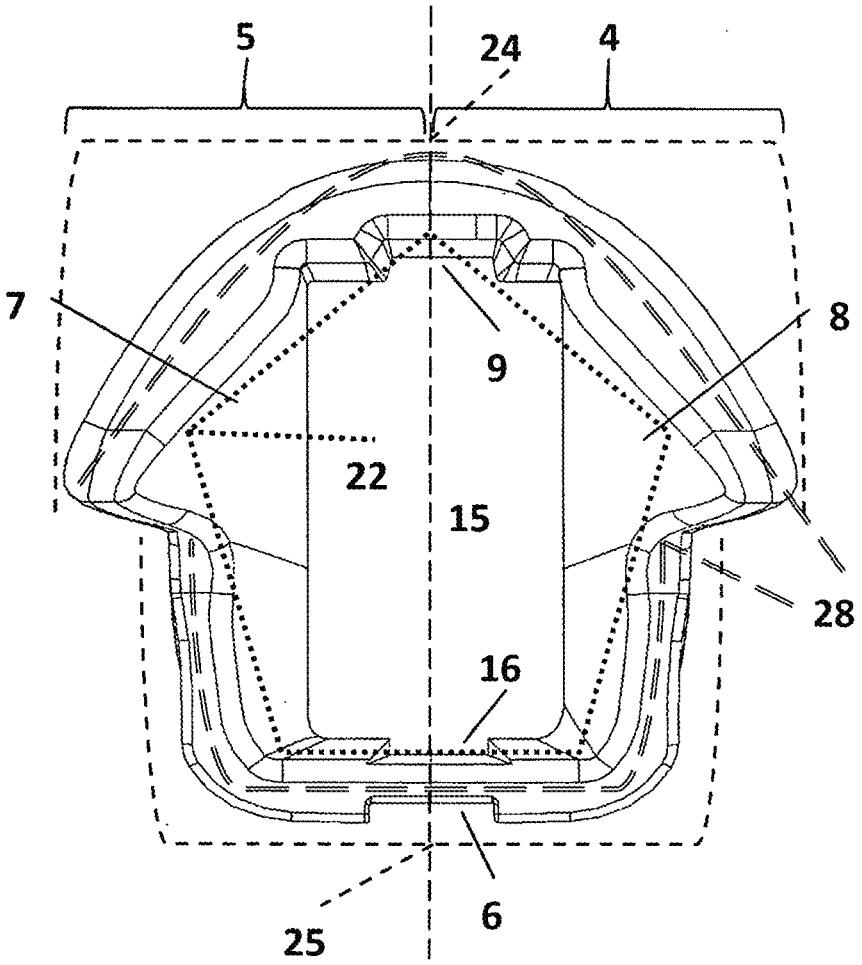

FIG. 14 is a bottom view of insertion guide 1 showing; right half 4, left half 5, magazine release lever channel 6, left lobe 7, right lobe 8, bolt hold open channel 9, interior front ramp surface channel 16. This view perhaps best shows the funnel shape resulting from right half 4 and left half 5 and their component features, particularly the channels that also help guide the magazine 3 (not shown) into position for full insertion into rifle 2 magazine well (not shown). The two halves are not perfectly symmetrical as the rifle 2 is not perfectly symmetrical laterally, there are pins and housing that had to be accommodated with the shape of right half 4 and left half 5 that make their height and thickness from center differ. In this view the thickness from edge difference is shown but not apparent to the eye, the rifle 2 is roughly $1/8^{th}$ to 1/4 inch thicker on the walls of its magazine well from right side to left side, the parts right half 4 and left half 5 accommodate this difference by differences in the depth of receiver molding channel 13 per side. The bolt hold open channel 9 on the back surface between left lower lobe 7 and right lower lobe 8 forms the full back working surface of the insertion guide 1, the bolt hold open channel 9 being fitted to the contour of the back of magazine 3 (not shown). The interior front ramp surface channel 16 similarly fits a protrusion on the front of magazine 3 and is tapered to be wider at the mouth to guide the magazine 3 into alignment with the interior of rifle 2 magazine well. Magazine opening 15 is the space between the right half 4 and left half 5, and bolt hold open channel 9 and interior front ramp surface channel 16; this space allows the magazine to pass thru the insertion guide 1 into the rifle 2 (not shown) magazine well. The bottom of magazine release lever channel 6 is visible on the forward edge of the insertion guide 1 in this view, this is the recess to allow the magazine release lever 21 (not shown) to fully depress when activated. Interior surface 22 is shown with all components of the funnel portion of the insertion guide 1 visible; left lobe 7, right lobe 8, bolt hold open channel 9 and interior front ramp surface channel 16. Large end 24 is toward the top of the drawing, small end 25 toward the bottom both bound in dashed brackets. Bottom edge 28 is the extreme lower boundaries of magazine release lever channel 6, left lobe 7, right lobe 8, bolt hold open channel 9, interior front ramp surface channel 16, exterior of mating surfaces 17 (not shown), interior surface 22 and exterior surface 23 (not shown).

Figure 15:
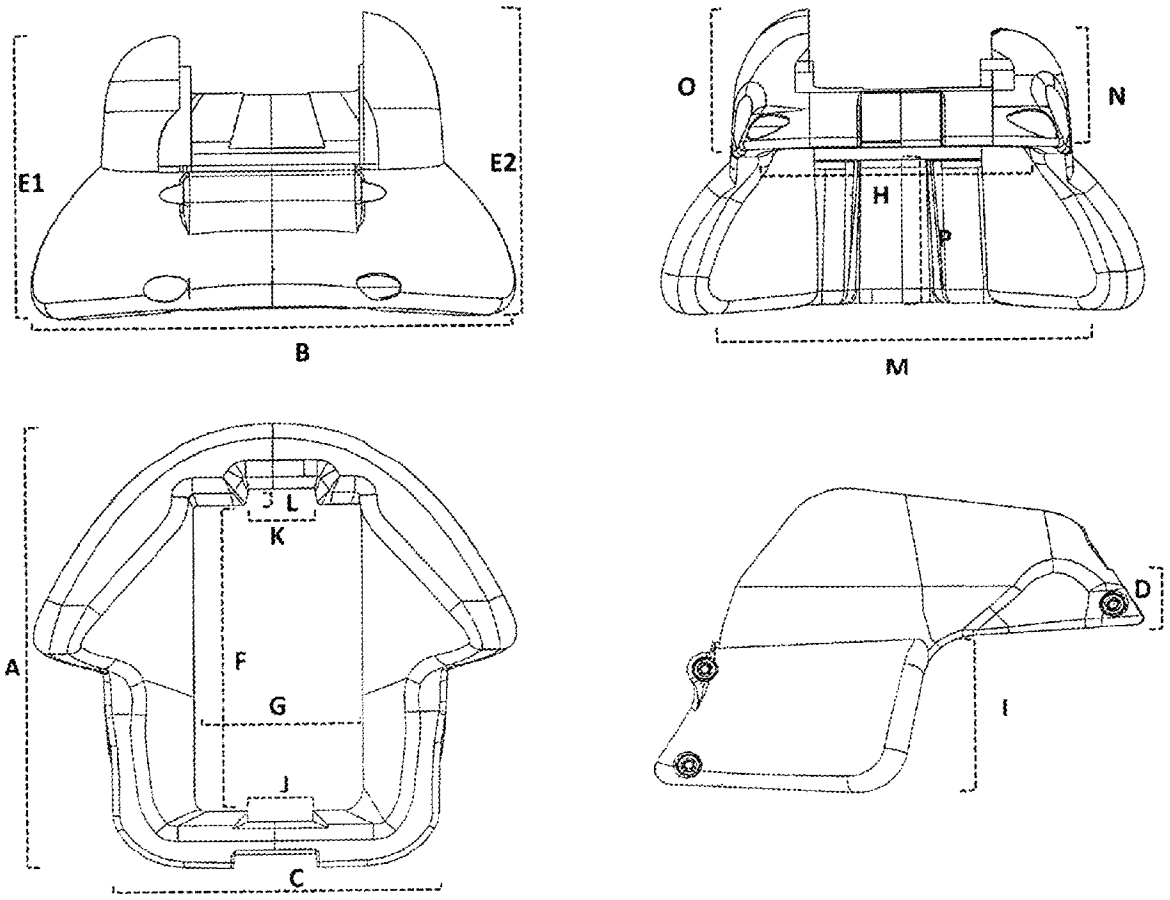

FIG. 15 shows the dimensions of one embodiment, listed under Additional Embodiments section. These dimensions can vary over a reasonable range.

Figure 16:
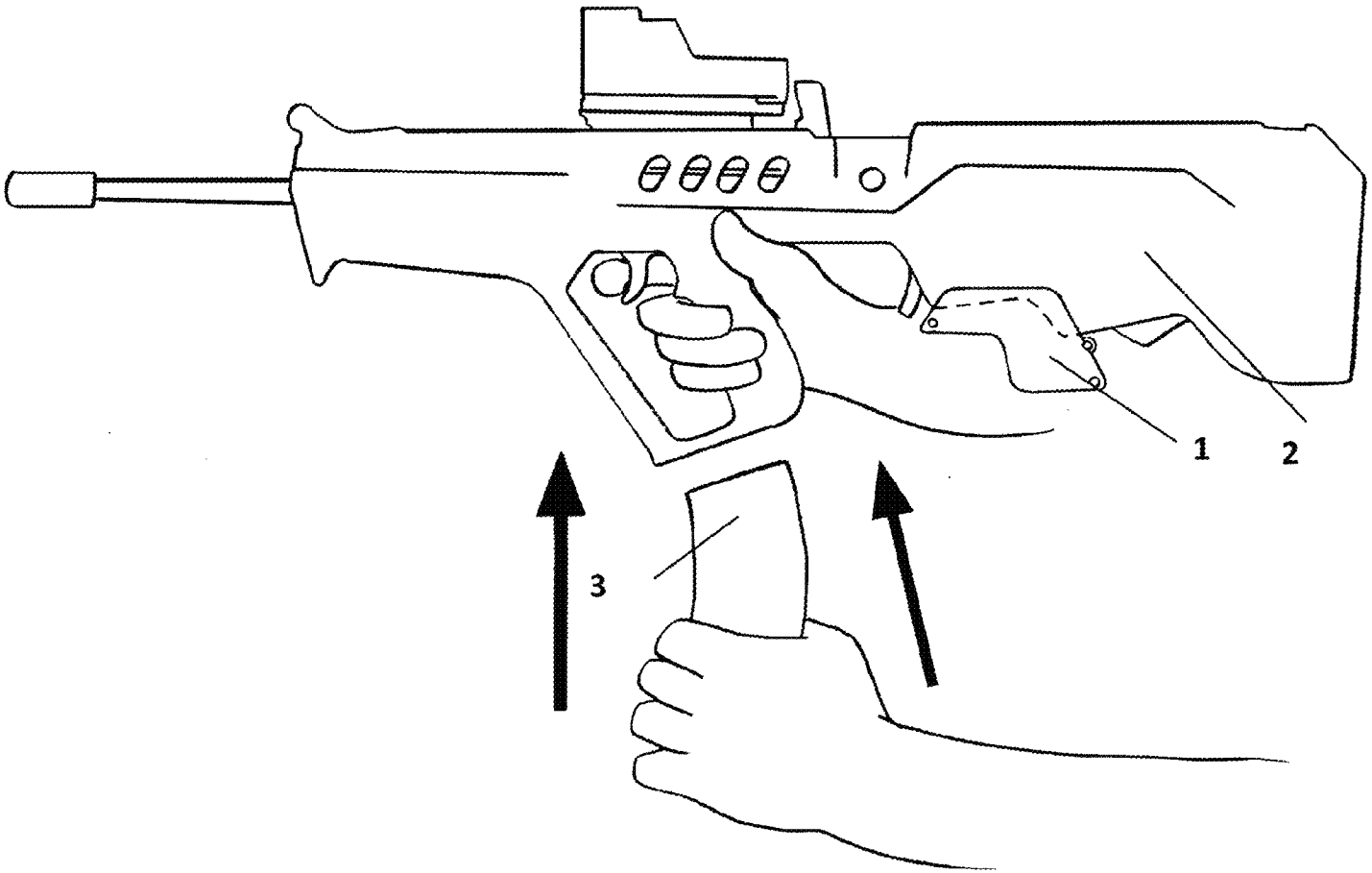
FIGS. 16-18 show the process of inserting the ammunition magazine 3 into the insertion guide 1 and into the rifle 2.

FIG. 16 is a left side view intended to illustrate the method of insertion showing; insertion guide 1, rifle 2 and magazine 3 with an operator's hands shown for illustration. This view is termed an "index position" based on the ergonomic principle that a person can find their strong hand with their weak hand in the dark. The operator brings the magazine 3 up toward their trigger hand to the bottom of the trigger guard of rifle 2 (the part under the hand).

Figure 17:
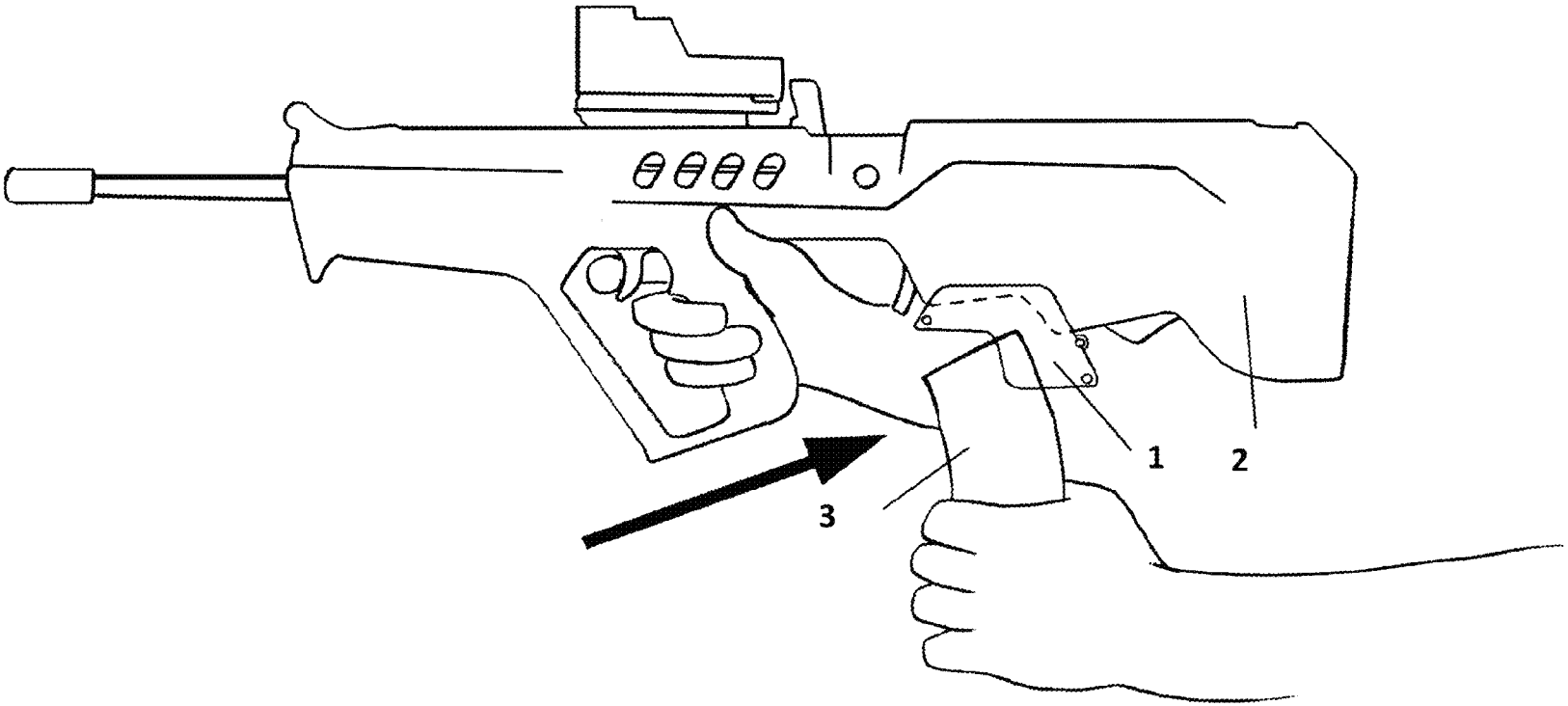

FIG. 17 is a left side view intended to illustrate the method of insertion showing; insertion guide 1, rifle 2 and magazine 3 with an operator's hands shown for illustration. This shows the operator moving their hand backward and upward toward the insertion guide 1 until the back of the magazine 3 engages the interior back surface of the insertion guide 1 (comprised of left lobe 7, right lobe 8 and bolt hold open channel 9—not shown individually in this drawing).

Figure 18:
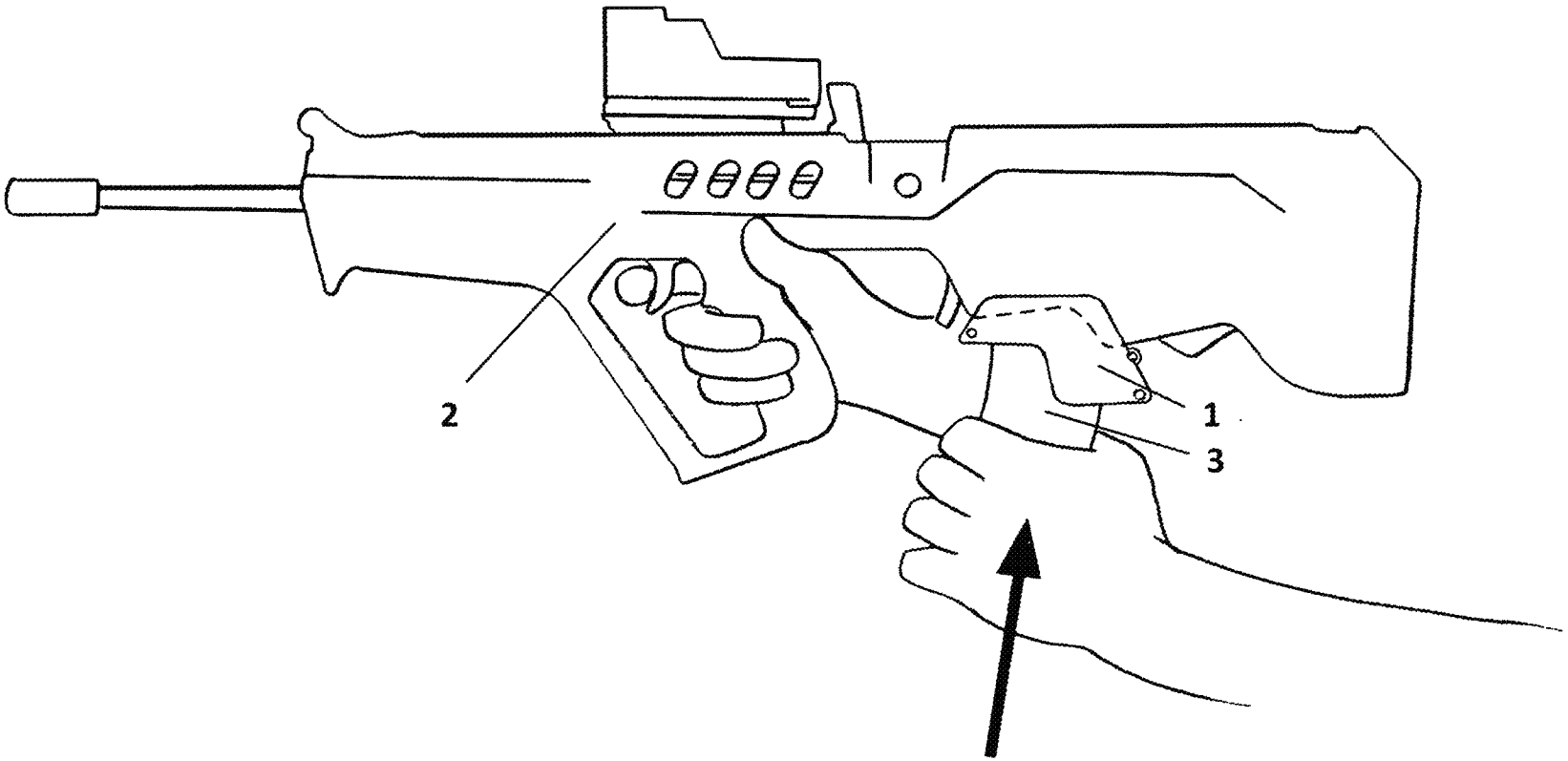

FIG. 18 is a left side view intended to illustrate the method of insertion showing; insertion guide 1, rifle 2 and magazine 3 with an operator's hands shown for illustration. This shows the operator shoving the magazine 3 upward thru the insertion guide 1 into the rifle 2. The sloped interior surfaces of insertion guide 1 correct any misalignment so that the magazine 3 goes in smoothly.

Figure 19:
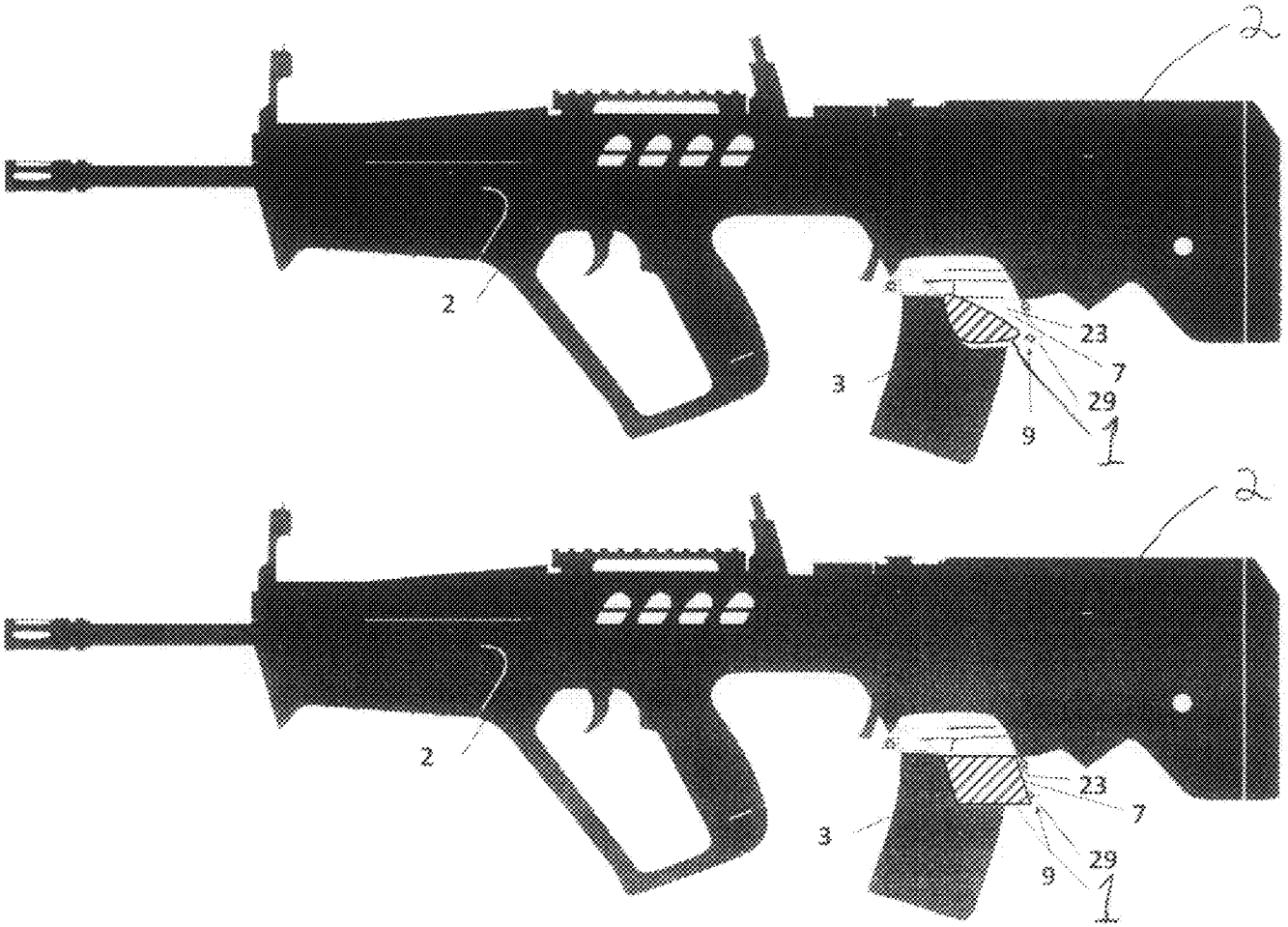
FIGS. 19 and 20 show alternate versions of the insertion guide 1.
Figure 20:
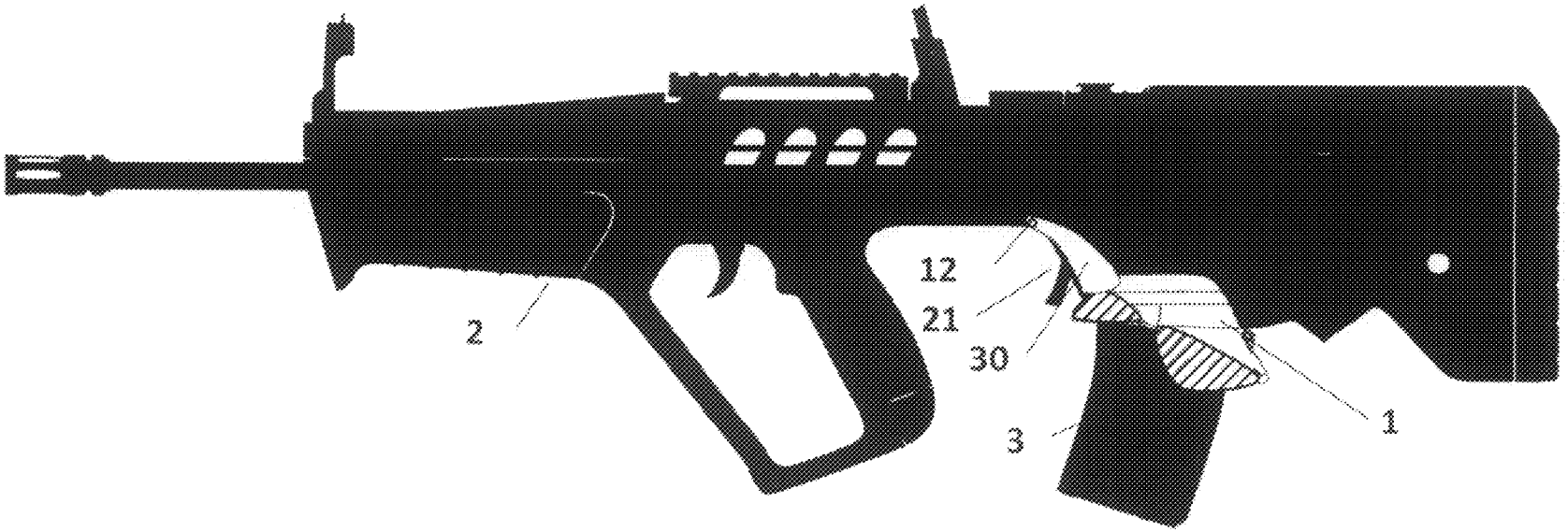

FIGS. 19 and 20—see below.

DESCRIPTION

Preferred Embodiment

The following embodiment or variation of the invention is the embodiment presently preferred by the Inventor, but over time other embodiments and variations and uses in other areas may become preferred to those skilled in the art.

The current version for the IWI Tavor rifle is the best embodiment at this time. Other bullpup rifles may involve embodiments that would fit them, or alternate embodiments may be created for the Tavor.

Operation of One Embodiment

The primary attachment of the invention to the gun is by friction using the contoured molding of the receiver to which the invention is form fitted. The magazine well guide is roughly box shaped when viewed from below (It is the internal surfaces of the magazine well extensions that this invention conforms to.) This is saying that the magazine is to be horizontally moved to meet that surface on the rear end of that "box" (engage the surface, or channel).

Installation: Fit the right and left halves to the sides of the rifle receiver adjacent to the magazine well of the rifle. The smaller end of the invention should be forward. Once the halves are snugly engaged and mated, insert the screws and tighten till snug (do not over torque).

Operation (insertion): To insert magazine, grasp magazine by the lower half with forward edge away from operator and ammunition on top. Bring the hand toward the trigger hand till the magazine top is under the trigger hand. Now move the magazine backward horizontally and slightly upward until it engages the back surface of the magazine well guide. Once the back of the magazine is firmly against the forward facing channel of the back of the magazine guide, shove the magazine upward firmly allowing the ramped surfaces on the side to straiten the magazine out in alignment with the internal magazine well of the firearm.

Operation (extraction): Grasp the magazine just below the magazine well guide and use the index finger to activate the gun's magazine release lever located on the front side of the firearm's magazine well. The side of the magazine well guide incorporates a shallow grove to help index the finger in alignment with the lever. Once lever is depressed, pull downward on the magazine to extract it from the magazine well.

Tests of One Embodiment

Initial testing of prototype shows that it does result in a successful magazine insertion where otherwise the angle or line of attack on the magazine well opening would have resulted in a failure by snagging, catching or otherwise not aligning with the opening

Additional Embodiments

Any bottom fed bullpup rifle requires an embodiment that incorporates the means of attachment to that specific firearm. This is necessary because each one is shaped differently and requires modifications of the invention to securely fasten to the magazine well of the firearm. Such modifications could be implemented after a person learns of the invention, its structure and operation.

As shown in FIG. 15 approximate dimensions for one embodiment of the invention are:

A) Front to back 3.5 inches (length of right half 4 or left half 5)

B) Side to side rear (both halves) 3.5 inches (distance between right lobe 8 and left lobe 7 outer edges)

C) Side to side front (both halves) 2.4 inches (distance from edge of right half 4 and left half 5 in front of lobes)

D) Top to bottom (front) 0.9 inches (height of interior front ramp surface channel 16)

E1) Top to bottom (rear) 2.4 inches (distance from bottom of lobes to top of right half 4)

E2) Top to bottom (rear) 2.5 (distance from bottom of lobes to top of left half 5)

F) Front to back (magazine opening 15) 2.5 inches

G) Side to side (magazine opening 15) 1.3 inches

H) Side to side (magazine opening 15 distal from firearm) 2.0 inches

I) Lobe height from body 1.3 inches

J) Width (interior front ramp surface channel 16) 0.5 inches

K) Width (bolt hold open channel 9) 0.5 inches

L) Depth (bolt hold open channel 9) 0.1 inch

M) Width between lobe interior (max between right lobe 8 and left lobe 7) 2.8 inches N) Height (exterior of mating surfaces of device 17 on left half 5) slope from 0.9 to 1.0 inches front to back O) Height (exterior of mating surfaces of device 17 on right half 4) slope from 0.9 to 1.3 inches front to back P) Top to bottom rear internal (height bolt hold open channel 9) 1.2 inches Dimensions could vary depending on the thickness of the walls of the invention (due to materials used, ergonomics etc), and dimensions necessary to mesh with different rifles and ammunition magazines. The main dimensions for one embodiment of the invention are the magazine opening 15 being large enough to allow the insertion of a magazine 3, width of (the magazine release lever channel 6, bolt hold open channel 9 and interior front ramp surface channel 16—all are minimum 0.5 inch or more) and the front height low enough to not interfere with access to the magazine release lever 21. Receiver molding channel 13 shape and depth etc are important for one embodiment of the invention, but due to the complexity of the geometry involved it is best to cast a molding of the receiver to create this portion, the exact dimensions won't matter as long as it is fitted to the molding of rifle 2. The size and shape of virtually all other dimensions are mutable to the preference of the user, ie wider mouth of opening, rise from back to front etc.

Attachment means for the right half 4 and left half 5 and other parts that may become separable by design request (for instance lobes 7 & 8 are considered too radical and in the way by military operators) may involve slot and groove, interlocking tabs, screws, latch, welding, heat fusing, or gluing or other means of attachment as appropriate to fit the needs of the geometry of the firearm and application (ie competition shooters desire a larger flared opening, military operators want a smaller more spare device).

At present only a model to fit the Tavor rifle (there are a few different versions of this as well and they likely all don't fit, i.e. the Micro Tavor may be subtly different in dimension on the mating surface as it is a smaller gun, but it does use the same magazines). Each different make/model would require different attachment points, and even methods. For example a Styr AUG has no molding and the bottom of the receiver is rounded like a boat hull. It's likely that a magwell made for that gun would require tapping into the receiver to mount screws, thus radically different as it would require modifying the firearm itself though the base part of the magwell funnel would be the same (also that discourages use by many as they are then altering and possibly devaluing their firearm for future sale). The Keltec RFB on the other hand has screws positioned roughly in the same pattern as the existing preferred embodiment and would primarily require altering of dimensions to match the insertion guide screw holes to the ones in the RFB's receiver and removal of the receiver molding channel 13 (which would just become a flat mating surface based on the RFB's geometry).

The guns this invention has potential to work with are other bullpup rifles that use 5.56 mm/.223 magazines. A scaled up version would work with ones using 7.62×51 mm/.308 magazines. Here is a mostly complete list of all bullpup firearms. Notably, Sniper Rifles are mostly moot (varying large calibers and non-standard magazines), shotguns are also not likely. Some pistols like the P90 mount the magazine on top and are totally incompatible with this device. Primarily there would be focus on the TAR-21 variants (that is, the official Israeli name for the Tavor), Styr AUG (Austria), L85 (Britain), FN2000 (Belgium), FAMAS (France—obsolete), G11 (Germany), DAR 21 (S. Korea), Keltec RFB (USA). The French and British are supposedly both replacing their guns; the British are already going to use G3s made by H&K in Germany (a conventional magazine forward gun); that situation may be uncertain as they now state the L85 is to stay in service till 2025. The French apparently have not decided on the replacement for the FAMAS—one of the aims with the present invention is to possibly help in selling the TAR-21 to the French, thereby potentially having a market for several million of these devices to go with them.

Alternative Embodiments

FIG. 19 shows an alternate embodiment (variation 1) illustrating insertion guide 1, rifle 2, magazine 3, left lobe 7, bolt hold open channel 9, exterior surface 23 and bottom edge 29. This involves trimming the forward edge of the lower lobes (left lobe 7 and right lobe 8) to better allow an operator's hand to grasp the magazine to unload. This would reduce the width of the insertion guide 1 so that operators who have their arms close on the side of the gun do not find the device impairing their grasp (based on direct feedback from Israeli Defense Force members). Similarly people with small hands or short arms may find the wide flare of the left lobe 7 (& right lobe 8) difficult to work around. Concurrently there may be a right and left handed version by so trimming one side and leaving the full flared lobe (7 or 8 depending on the handedness of the operator) on the other side. The trimming would result in a smoother lower line from front to back that would reduce the incidence of having to reach around the device to grab the magazine. Lower lobe on both sides is receded as shown resulting in a flatter lower surface that rises toward the front of the firearm. The first image shows a partial trimming (cross hatched area is removed) whereas the second shows full removal of left lobe 7 (and right lobe 8 which is not visible) leaving just the back portion of the bottom bolt hold open channel 9 (not directly visible), exterior surface 23 and bottom edge 29.

FIG. 20 shows an alternate embodiment which includes variation 1 and illustrates insertion guide 1, rifle 2, magazine 3, screw hole 12 (relocated front hole), magazine release lever 21 and extrusion 30. It involves trimming the forward corner (cross hatched area removed) to further reduce any interference with the operator's finger accessing the magazine release lever 21, i.e. due to having small hands. Concurrently the forward edge would be raised above the magazine release lever resulting in the front screw hole 12 being relocated roughly 2 inches higher and the portion of the front featured such as magazine release lever channel 6 and index finger indentation 19 removed and replaced with an extrusion 30 running along the surface of rifle 2 on both sides with a connecting screw hole 12 located above the magazine release lever 21.

Multiple variations exist by material, i.e. Polyethylene, Urethane, fiberglass impregnated ABS plastic etc. as well as different methods of production. Materials for the two halves of the device could include one or more of the following: injection molded plastic, metal, sintered metal, fiberglass, or 3-D printed material. In addition to screws, the means for joining the two halves of the insertion guide could include one or more of the following (or other means for joining known to those skilled in the art): latch, welding, heat fusing, or gluing.

Suggestions were made by military operators on altering the shape of certain aspects of the insertion guide, particularly with respect to the outer edges of the lower lobes and the front corners by the magazine release lever. These suggestions are reflected in the Alternate Embodiments.

Alternate Embodiments may alter or exclude half-cylindrical, receiver molding channel as it is specific to the rifle (IWI Tavor) but not various others (ie Steyr AUG or Keltec RFB). In those cases it may be replaced with a flat surface or concave surface to mate with the receiver of the rifle, so in fact this channel comprises the primary mating surface of the insertion guide.

Other embodiments would be similar in design and method of the lower portion of the invention, the upper portion being the mating area to the particular firearm; each firearm would require a variation of the upper surfaces of the invention to allow attachment to the firearm.

CONCLUSIONS, RAMIFICATIONS AND SCOPE

A number of changes are possible to the methods, parts, uses described above while still remaining within the scope and spirit of the invention. The specifics about the form and use of the invention described in this application (including the specifics in the Background, Field, Related Art, Summary, Purposes and Advantages, Abstract, Preferred Embodiment, Additional Embodiments, and Alternative Embodiments, Descriptions of the Drawings, etc.) are examples and are not intended to be limiting in scope. Those skilled in the art will recognize certain variations, modifications, permutations, additions, subtractions and sub-combinations thereof, and may discover new fields of use. The scope of the invention is to be determined by the claims and their legal equivalents, not the examples, purposes, summary, preferred embodiments, alternative or additional embodiments, operation, tests, parameters, or limitations etc. given above. It is intended that the claims are interpreted to include all such variations, modifications, additions, subtractions, permutations and sub-combinations as are within their true spirit and scope, including those which may be recognized later by those skilled in the art.

Even though particular combinations of features are recited in the claims and/or disclosed in the specification, these combinations are not intended to limit the invention. In fact, many of these features may be combined in ways not specifically recited in the claims and/or disclosed in the specification.

No element, act, or instruction used in the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

I claim:

1. An insertion guide, having a right half and a left half and an interior surface and an exterior surface and having a larger end and a smaller end, and a top and bottom, for a bullpup pattern rifle comprising:

(a) a substantially rectangular magazine opening, having a width and a length, contained between the right half of the insertion guide and the left half of the insertion guide, the length of the rectangular magazine opening lying between the larger end and the smaller end of the insertion guide, (b) a left lobe and a right lobe forming part of the right half of the insertion guide and the left half of the insertion guide respectively, and flaring outwardly from the length of the magazine opening in (a) and comprising part of the larger end of the insertion guide, (c) a bolt hold open channel cut out from the interior surface of the right half and the left half of the insertion guide, and from the larger end of the insertion guide, and positioned approximately half way between the right lobe and the left lobe of the insertion guide in (b) and sized to be approximately one half of the width of the magazine opening and facing the width of the magazine opening, (d) an interior front ramp surface channel cut out from the interior surface of the right half and the left half of the insertion guide in (a), and out of the smaller end of the insertion guide, and positioned approximately half way between the right half of the insertion guide and the left half of the insertion guide, and facing the width of the magazine opening and sized to be approximately one half of the width of the magazine opening and positioned on the opposite, smaller end of the magazine opening from the channel in (c), and (e) a magazine release lever channel cut out from the right half and the left half of the insertion guide and on the exterior surface of the insertion guide and in the smaller end of the insertion guide opposite the lobes and opposite the larger end of the insertion guide containing the bolt hold open channel in (c).

2. The insertion guide of claim 1, further comprising two substantially concave, generally v-shaped, half-cylindrical, receiver molding channels cut out partly (i) from the interior surface of the top of the insertion guide and parallel to the bottom edge of the insertion guide, and partly (ii) from the interior surface of the larger end of the insertion guide and parallel to the surface of the larger end of the insertion guide.

3. The insertion guide of claim 2, further comprising a substantially round indentation in one side of the interior surface and top surface of the insertion guide and extending into one of the two receiver molding channels.

4. The insertion guide of claim 2, further comprising one or more screws positioned to join the two halves of the insertion guide.

5. The insertion guide of claim 1 for a bullpup pattern rifle comprising a left half and a right half, wherein the two halves are joined by a means for joining the two halves.

6. The insertion guide of claim 1 for a bullpup pattern rifle comprising a left half and a right half, wherein the two halves are joined by one of the group consisting of: screws, latch, welding, heat fusing, and gluing.

7. The insertion guide of claim 1, wherein the material for the guide comprises one or more of the following: injection molded plastic, metal, sintered metal, fiberglass, and 3-D printed material.

8. The insertion guide of claim 2 for a bullpup pattern rifle comprising a left half and a right half, wherein the two halves are joined by a means for joining the two halves.

9. The insertion guide of claim 2 for a bullpup pattern rifle comprising a left half and a right half, wherein the two halves are joined by a means for joining them selected from the group consisting of: slot and groove, interlocking tabs, screws, latch, welding, heat fusing, and gluing.

10. The insertion guide of claim 2 for a bullpup pattern rifle comprising a left half and a right half, wherein the material for the guide comprises one or more of the following: injection molded plastic, metal, sintered metal, fiberglass, and 3-D printed material.

* * * * *